US007851044B2

(12) United States Patent
Matsumoto

(10) Patent No.: US 7,851,044 B2
(45) Date of Patent: Dec. 14, 2010

(54) IMAGE DISPLAY DEVICE AND IMAGE SHEET

(75) Inventor: Iwao Matsumoto, Osaka (JP)

(73) Assignee: Photo Craft Co., Ltd., Osaka (JP)

( * ) Notice: Subject to any disclaimer, the term of this patent is extended or adjusted under 35 U.S.C. 154(b) by 245 days.

(21) Appl. No.: 10/885,673

(22) Filed: Jul. 8, 2004

(65) Prior Publication Data

US 2005/0008792 A1 Jan. 13, 2005

(30) Foreign Application Priority Data

Jul. 11, 2003 (JP) ..... 2003-196040

(51) Int. Cl.
*B44F 1/00* (2006.01)

(52) U.S. Cl. ..... 428/138; 428/137

(58) Field of Classification Search ..... 428/131, 428/138, 913, 918, 137; 359/594, 536
See application file for complete search history.

(56) References Cited

U.S. PATENT DOCUMENTS

| | | | | |
|---|---|---|---|---|
| 5,609,938 A | | 3/1997 | Shields | |
| 5,830,529 A | * | 11/1998 | Ross | 427/152 |
| 6,030,687 A | * | 2/2000 | Andriash | 428/138 |
| 6,166,856 A | * | 12/2000 | Araki et al. | 359/627 |
| 6,242,076 B1 | * | 6/2001 | Andriash | 428/138 |
| 6,767,609 B2 | | 7/2004 | Aeling et al. | |

FOREIGN PATENT DOCUMENTS

| | | | |
|---|---|---|---|
| EP | 1 103 943 | A2 | 5/2001 |
| EP | 1 103 943 | A3 | 5/2001 |
| JP | 57-782 | U | 1/1982 |
| JP | 59-222835 | A | 12/1984 |
| JP | 2001-255837 | A | 9/2001 |
| JP | 2002-23670 | A | 1/2002 |
| JP | 2002-99230 | A | 4/2002 |
| JP | 2002-192638 | A | 7/2002 |
| WO | WO-99/21158 | A1 | 4/1999 |

* cited by examiner

*Primary Examiner*—Alicia Chevalier
(74) *Attorney, Agent, or Firm*—Birch, Stewart, Kolasch & Birch, LLP

(57) ABSTRACT

An image display device is provided that can be reduced in size and weight by using an EL and can display a clear image whose color does not change by any of reflected light or transmitted light. The image display device includes an opaque first image layer on a surface of which a first image is formed, the first image layer being made of a sheet-like material and being provided with a plurality of holes, a second image layer that is placed on a back surface of the first image layer and is made of a transparent sheet on which a second image is formed, the second image being visible through the plural holes, and a lighting system for illuminating the second image from a back, the lighting system being placed on a back surface of the second image layer.

6 Claims, 3 Drawing Sheets

IMAGE DISPLAY DEVICE AND IMAGE SHEET

This Non-provisional application claims priority under 35 U.S.C. §119(a) on Patent Application No(s). 2003-196040 filed in Japan on Jul. 11, 2003, the entire contents of which are hereby incorporated by reference.

BACKGROUND OF THE INVENTION

1. Field of the Invention

The present invention relates to an image display device capable of displaying an image with light from the front, light from the back or both the light from the front and the light from the back, and an image sheet.

2. Description of the Related Art

Conventionally, an image display device for ornament or for advertisement is often installed in a station yard, an interior wall of a hotel or a department store, an exterior wall of a building or the like.

Generally, such an image display device has a structure where an image sheet on which an image is formed is mounted in an appropriate panel frame and a fluorescent lamp is installed as a backlight so as to illuminate the image sheet from a back surface thereof. An identical image is printed on both surfaces of a support including translucent milky white films, which is used as the image sheet. Instead of printing, photographic printing is performed for forming an image sheet (Japanese Unexamined Patent Publication No. 59-222835).

In such an image display device, an image can be seen clearly at appropriate density with transmitted light by illumination from the back. Even when the illumination from the back is turned off, to some extent, the image can be clearly seen at appropriate density with reflected light of external light.

In the conventional image display device mentioned above, however, a fluorescent lamp is used as a backlight. Accordingly, a lighting system is large in size and shape, making the entire image display device large in size and weight.

It is conceivable that an EL (electroluminescence light) is used as a lighting system for such a backlight.

Zinc sulfide is usually used as a light emission source of the EL for enhancement of luminance. In this case, since a light emission color becomes blue green, the EL cannot be used as a backlight for a color image for practical purposes. Then, a correction is so performed that white light or a daylight color is emitted by coating a surface of the light emission source with pink (peach color/red species) that is a color opposite to blue green. However, in the case of representing a color image using the light source whose surface color is pink, when an image is printed on a milky white sheet-like material and is used, a problem arises in which exact colors cannot be displayed.

More specifically, in the case of seeing an image formed on a milky white sheet-like material by using the EL as a backlight, the surface color of pink influences a color of the image when the image is seen by any of reflected light (front light) or transmitted light (backlight), even if the usage differs to some extent in light intensity between the reflected light and the transmitted light. As a result, the color of the image changes to a pinkish color and exact colors cannot be represented.

SUMMARY OF THE INVENTION

The present invention is directed to solve the problems pointed out above, and therefore, an object of the present invention is to provide an image display device that can be reduced in size and weight by using an EL and can display a clear image whose color does not change by any of reflected light or transmitted light, and an image sheet.

According to one aspect of the present invention, an image display device includes an opaque first image layer on a surface of which a first image is formed, the first image layer being made of a sheet-like material and being provided with a plurality of holes, a second image layer that is placed on a back surface of the first image layer and is made of a transparent sheet on which a second image is formed, the second image being visible through the plural holes, and a lighting system for illuminating the second image from a back, the lighting system being placed on a back surface of the second image layer.

Preferably, the first image is an image for reflected light and the second image is an image for transmitted light. Further, the first image and the second image are images about one same motif, and are images observed as one unified image when the first image and the second image are viewed with being composited together.

Preferably, the first image is an image for reflected light and the second image is an image for transmitted light. Further, the first image and the second image are images about one same motif, and are images observed as one unified image when the first image and the second image are viewed with being composited together.

Preferably, a sheet-like electroluminescence light is used as the lighting system. Thereby, the entire image display device is reduced in size and weight.

Further, the second image that can be observed thorough the holes is formed on a transparent sheet. Thereby, even when a surface color of a backlight of the lighting system is a pink color, since light emitted from a light source passes through the transparent sheet, the sheet barely interferes with the pink color. Accordingly, a color of the image is prevented from changing to a pinkish color.

These and other characteristics and objects of the present invention will become more apparent by the following descriptions of preferred embodiments with reference to drawings.

DESCRIPTION OF THE PREFERRED EMBODIMENTS

Figure 1:
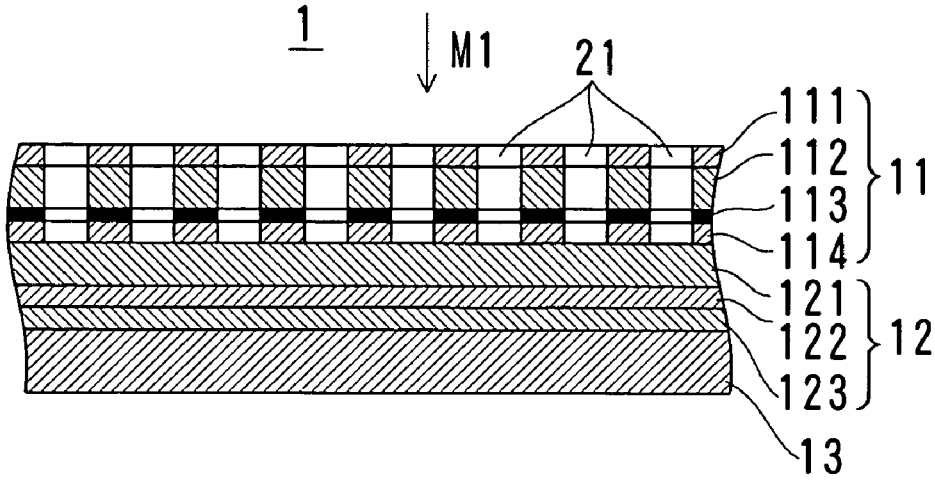
FIG. 1 is a cross section showing a structure of an image display device according to the present invention.
Figure 2:
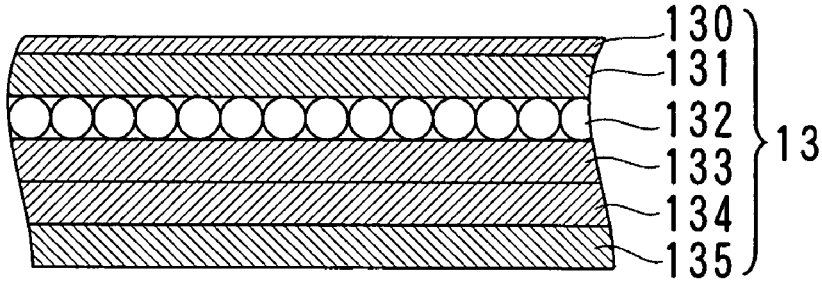
FIG. 2 is a cross section showing an example of a structure of a lighting system.
Figure 3:
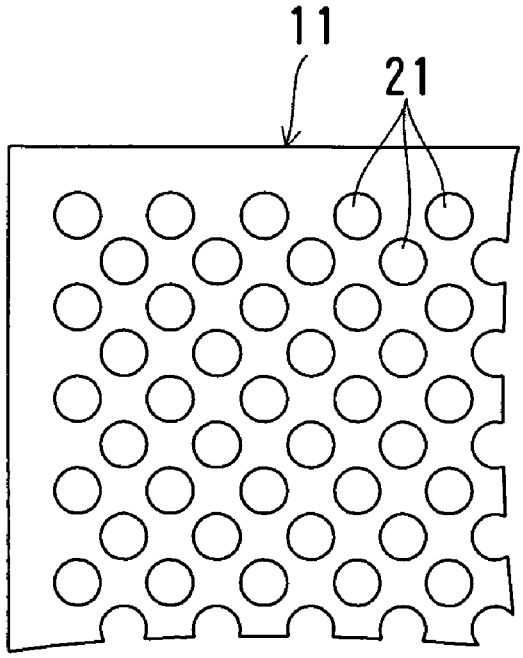
FIG. 3 is a front view of a first image layer.
Figure 4:
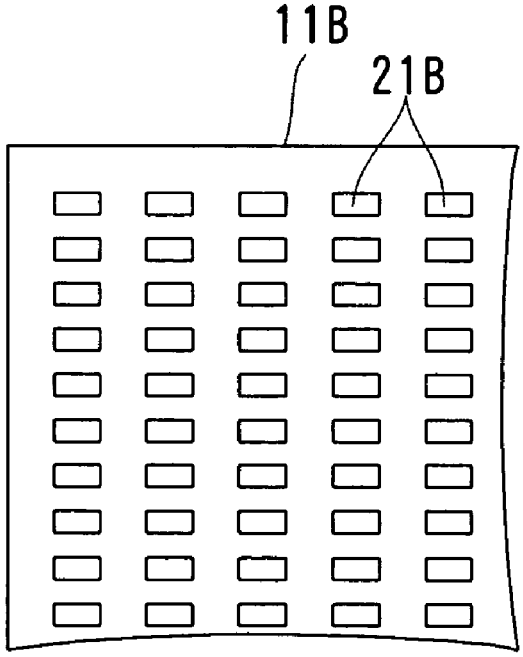
FIG. 4 is a front view showing a first image layer in another example.
Figure 5:
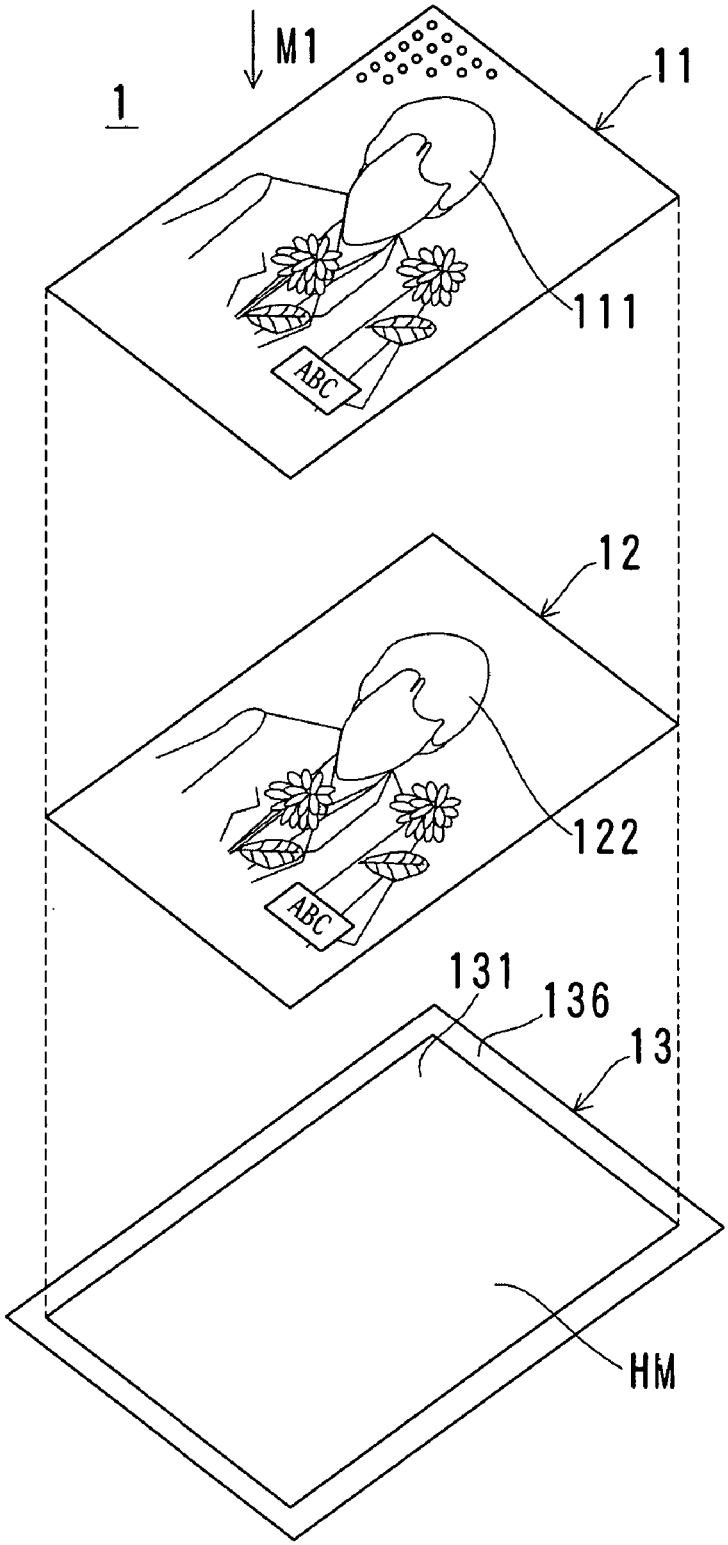
FIG. 5 is an exploded perspective view of the image display device.

FIG. 1 is a cross section showing a structure of an image display device 1 according to the present invention, FIG. 2 is a cross section showing an example of a structure of a lighting system 13, FIG. 3 is a front view of a first image layer 11, FIG. 4 is a front view showing a first image layer 11B in another example and FIG. 5 is an exploded perspective view of the image display device 1.

Referring to FIG. 1, the image display device 1 includes the first image layer 11, a second image layer 12 and the lighting system 13.

The first image layer 11 is made of an opaque sheet and is provided with a number of holes. A first image 111 is formed on a surface of the first image layer 11. More particularly, the first image layer 11 includes a sheet-like material 112, the first image 111 formed on a surface of the sheet-like material 112, a black light shielding layer 113 formed on a back surface of the sheet-like material 112 and an adhesive layer 114 formed on a surface of the light shielding layer 113. The first image layer 11 is provided with a number of holes 21, 21 . . . .

As a material of the sheet-like material 112, a flexible synthetic resin such as PET, polyester or polypropylene is used. The sheet-like material 112 has a thickness of approximately a few tenths millimeters to a few millimeters.

An ink jet printer is used to print an image on the surface of the sheet-like material 112, so that the first image 111 is formed. When ink does not seep into the surface of the sheet-like material 112 sufficiently, it is sufficient that the surface of the sheet-like material 112 is coated for improving perviousness of ink.

Alternatively, the first image 111 can be formed by performing photographic printing on the surface of the sheet-like material 112. In such a case, a photographic emulsion layer is provided on the surface of the sheet-like material 112. Then, an exposure is performed on the photographic emulsion layer to print an image for development and fixing. The first image 111 may be provided with a protection layer on its surface.

As shown in FIG. 3, the first image layer 11 has the multiple circular holes 21 in the horizontal and vertical directions. In the present embodiment, though a screen angle by the multiple holes 21 is 45 degrees, other angles are possible.

Alternatively, as shown in FIG. 4, it is possible to use the first image layer 11B on which a number of rectangular holes 21B.

An opening rate provided by such holes 21, in other words, a total area of the holes 21 to a surface area of the first image layer 11 is approximately 50%. Instead, the opening rate may be another value such as 30%, 40%, 60% or 70%.

The holes 21 are formed so as to penetrate from a front surface of the first image layer 11 to a back surface thereof. In the case of forming the holes 21, first, the holes 21 may be provided on the first image 111, and after that, the sheet-like material 112, the light shielding layer 113 and the adhesive layer 114 may be provided on the first image 111. In such a case, it should be noted that the sheet-like material 112, the light shielding layer 113 and the adhesive layer 114 are prevented from being formed at the portions of the holes 21. However, when the adhesive layer 114 is transparent, the adhesive layer 114 may be formed at the portions of the holes 21.

Alternatively, it is possible to form the first image 111, the light shielding layer 113 and the adhesive layer 114 on the sheet-like material 112 with no holes 21, and after that, to form the holes 21.

Thus, the first layer 111 is formed only at portions where the holes 21 are not formed of the surface of the first image layer 11. In the case of seeing the first image 111 actually, from a practical standpoint, a viewer can see the image from a distance to a permissible extent of sharpness, though the sharpness of the image is slightly lower compared to the case where no holes 21 are formed.

The adhesive layer 114 serves to bond the sheet-like material 112 or a laminate based on the sheet-like material 112 to the second image layer 12. The adhesive layer 114 is required to be moderately transparent so as to see through the second image layer 12. The adhesive layer 114 may have a structure like a two-sided tape. The adhesive layer 114 may be provided on a surface of the second image layer 12. When the first image layer 11 is integral with the second image layer 12, the adhesive layer 114 may be omitted.

The second image layer 12 is placed at the back surface of the first image layer 11. A second image 122 capable of being observed through the multiple holes 21 is formed on the second image layer 12. More specifically, the second image layer 12 includes a transparent sheet-like material 121, the second image 122 formed on a surface of the sheet-like material 121 and an adhesive layer 123 provided on a surface of the second image 122.

As a material of the sheet-like material 121, a flexible synthetic resin such as PET, polyester or polypropylene is used. The sheet-like material 121 has a thickness of approximately a few tenths millimeters to a few millimeters.

An ink jet printer is used to print an image on the surface of the sheet-like material 121, so that the second image 122 is formed. Transparent coating may be coated on the surface of the sheet-like material 121 in order to improve perviousness of ink thereon. Alternatively, photographic printing may be performed on the surface of the sheet-like material 121 to form the second image 122. The surface of the second image 122 may be provided with a protection layer.

In the present embodiment, the first image 111 and the second image 122 are images about the same motif. When being viewed with being composited together, the first image 111 and the second image 122 are observed as one unified image. Stated differently, there are no differences in image contents between the case of seeing one of the images and the case of seeing the both images, ending up seeing the same image. The images, however, may be images about motifs different from each other. It is possible that, for example, one of the images is a person and the other is scenery, one of the images is a person and the other is a different person, or one of the images is scenery and the other is different scenery. When being seen at the same time, the images are viewed with being composited together. The images may include line drawings or characters to be combined together. Further, the images may be identical images in other colors.

Note that the first image 111 is an image for reflected light, while the second image 122 is an image for transmitted light. More particularly, when the surface of the first image layer 11 is illuminated by external light, the reflected light thereof is incident on viewer's eyes, so that the first image 111 is observed. In contrast, with respect to the second image 122, transmitted light by illumination from the back using the lighting system 13 as described later is incident on viewer's eyes, so that the second image 122 is observed. Accordingly, the second image 122 is required to have density (a contrast) higher than the first image 111.

The adhesive layer 123 serves to bond the sheet-like material 121 or a laminate based on the sheet-like material 121 to the lighting system 13. The adhesive layer 123 is required to be moderately transparent so as to transmit light or so as to be prevented from being colored by the lighting system 13. The adhesive layer 123 may have a structure like a two-sided tape. When the sheet-like material 121 or the laminate based on the sheet-like material 121 is not bonded to the lighting system 13, the adhesive layer 123 is unnecessary.

The lighting system 13 is installed at a back surface of the second image layer 12 and illuminates the second image 122 from the back. In the present embodiment, an inorganic EL (electroluminescence light) is used as the lighting system 13.

As shown in FIG. 2, the lighting system 13 as the inorganic EL includes a protection layer 130, a transparent electrode 131, a light emission layer 132, an insulation layer 133, a back electrode 134 and a protection layer 135. The lighting system has a surface size as same as that of each of the first image layer 11 and the second image layer 12 and a thickness of approximately a few tenths millimeters to a few millimeters. Application of an alternating voltage causes light emission of the lighting system 13.

The transparent electrode 131 can be, for example, a PET film with ITO. In such a case, for instance, an ITO (indium tin oxide) film is formed on transparent PET with a thickness of a few hundred micrometers by continuous sputtering.

The light emission layer 132 can be, for example, a layer in which impurities are doped on Zns (zinc sulfide). Copper is generally used as the impurities, and thereby, the layer emits light of blue green. The light emission color of blue green is advantageous to luminance, life and stability. However, since light emitted outward is made a white color or a daylight color, pink that is a complementary color to blue green is used for correction. As the correction method, pink pigment is mixed in the light emission layer 132 of ZnS at a rate of approximately a few percentages. As another correction method, a thin film is formed on the PET film by the pink pigment and the thin film is placed on a surface of the light emission layer 132 as a filter.

The pink pigment can be inorganic pigment or organic pigment. As the inorganic pigment, coral pink such as Zr.Si.Fe, a Cr.Si.Al compound, or pale pink such as an Au.Si.Al.Na compound is used. Further, it is possible to mix yellow and light red suitably. Praseodymium such as Zr.Si.Pr is used as yellow, while Cr.Ti.Sb is used as red.

The protection layer 130 and the protection layer 135 serve to seal a laminated structure including the transparent electrode 131, the light emission layer 132, the insulation layer 133 and the back electrode 134 and to protect the entire lighting system 13 against water and humidity.

As the lighting system 13, Els having various known structures can be used. The lighting system 13 can be provided with a base member for mechanical protection or installation. The lighting system 13 shown in FIG. 5 is provided with such a base member 136.

Here, an explanation is given to a use of the image display device 1 structured as discussed above.

When the lighting system 13 is not supplied with power, i.e., when the lighting system 13 does not emit light; a surface HM of the lighting system 13 is pink. When being seen by an observer from the direction of an arrow M1, the first image 111 in the first image layer 11 is illuminated by external lighting, so that the first image 111 is observed by the reflected light. Since the second image layer 12 is seen only through the holes 21 formed on the first image layer 11, the second image layer 12 is set back darkly and is not clearly observed as an image. Though the surface HM of the lighting system 13 is pink, since the entire second image layer 12 is transparent, the pink is not conspicuous. Accordingly, a color of the image seen by the observer is not a pinkish color.

When the lighting system 13 is supplied with power, i.e., when the lighting system 13 emits light; white light is emitted. Accordingly, the second image 122 in the second image layer 12 is clearly observed by illumination from the back. Since the second image 122 is illuminated by white light, the second image 122 is reproduced by faithful colors to the original image. In such a case, when external light is present, the first image 111 in the first image layer 11 is observed at the same time. Even if the external light is strong like a sunbeam, since the sheet-like material 121, i.e., the entire second image layer 12 is transparent, the pink is not conspicuous. In the case of no external light, the entire image is seen clearly enough only by the second image 122.

Therefore, it is possible to observe a clear image in which colors are represented precisely regardless of being daytime or nighttime, and indoor or outdoor.

In the embodiment described above, the explanation is made to the structure where the first image layer 11, the second image layer 12 and the lighting system 13 are integral with one another. Instead, for example, a structure is possible in which only the first image layer 11 and the second image layer 12 are integral with each other and the integrated layers may be made an image sheet. In such a case, when the adhesive layer 123 is provided on the surface of the second image layer 12, a release sheet may be provided on the surface thereof. Then, the image sheet may be placed on an appropriate lighting system using an appropriate EL or fluorescent lamp and be used by illumination from the back.

Structures, shapes, sizes, the number and materials of each part or whole part of the image display device 1 and image contents can be varied as required within the scope of the present invention.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An image display device comprising:

an opaque first image layer on a front surface of which a first image is formed, a back surface of the first image layer being a light shielding black layer, and the first image layer including a sheet material located between the first image and the light shielding black layer and being provided with a plurality of holes penetrating through the first image, the sheet material, and the light shielding black layer;

a second image layer having an obverse side and a reverse side, wherein the obverse side that is placed on the back surface of the first image layer and is made of a transparent sheet on which a second image is formed, the transparent sheet directly facing the first image layer, and the second image being formed on a reverse side of the transparent sheet so as to have a density higher than that of the first image and be visible when observed through the plurality of holes in a thickness direction; and a sheet electroluminescence lighting system for illuminating the second image from a back, the lighting system being placed on the reverse side of the second image layer wherein the second image is located between the transparent sheet and the lighting system and comprising a light emission layer including pink pigment so that an emission of lighting a blue green color is corrected to emit a white light or a daylight color, wherein the plurality of holes and the light shielding black layer are arranged such that the first image is adapted to be observed by an observer facing the first image layer via reflected light from an external lighting and that the second image is adapted to be observed by the observer facing the first image layer through the plurality of holes via transmitted light from the lighting system when the lighting system emits light, and wherein the plurality of holes and the light shielding black layer are arranged such that a pink color of the pink pigment is not observed by the observer facing the first image layer through the plurality of holes in a thickness direction via reflected light from the external lighting.

2. The image display device according to claim 1, wherein the sheet electroluminescence lighting system is provided with a thin film including the pigment placed on a surface of the light emission layer.

3. The image display device according to claim 1, wherein the first image and the second image are images about one same motif, and are images observed as one unified image when the first image and the second image are viewed with being composited together.

4. An image display device comprising:

a first image layer comprising:

an opaque first sheet material having an obverse side and a reverse side, a first image formed on the obverse side of the first sheet material, a light shielding black layer having an obverse side and a reverse side formed on the reverse side of the first sheet material, and a first adhesive layer formed on the reverse side of the light shielding black layer;

a plurality of holes penetrating through the first image, the first sheet material, and the light shielding black layer of the first image layer;

a second image layer having an obverse side and a reverse side comprising:

a transparent second sheet material having an obverse side and a reverse side placed to face the first adhesive layer, a second image formed on the reverse side of the second sheet material, the reverse side of the second sheet material being a side opposite to the obverse side of the second sheet material facing the first image layer, and a second adhesive layer formed on a reverse side of the second image; and a sheet electroluminescence lighting system provided on a reverse side of the second adhesive layer wherein the second adhesive layer is located between the second image layer and the lighting system for illuminating the second image from a back of the second image layer and comprising a light emission layer including a pink pigment so that an emission of light in a blue green color is corrected to emit a white light or a daylight color, wherein the plurality of holes and the light shielding black layer are arranged such that the first image is adapted to be observed by an observer facing the first image layer via reflected light from an external lighting and that the second image is adapted to be observed by the observer facing the first image layer through the plurality of holes via transmitted light from the lighting system when the lighting system emits light, and wherein the plurality of holes and the light shielding black layer are arranged such that a pink color of the pink pigment is not observed by the observer facing the first image layer through the plurality of holes in a thickness direction via reflected light from the external lighting.

5. The image display device according to claim 4, wherein the sheet electroluminescence lighting system is provided with a thin film including the pigment placed on a surface of the light emission layer.

6. The image display device according to claim 4, wherein the first image and the second image are images about one same motif, and are images observed as one unified image when the first image and the second image are viewed with being composited together.

* * * * *